US007326127B2

(12) United States Patent
Hou et al.

(10) Patent No.: US 7,326,127 B2
(45) Date of Patent: Feb. 5, 2008

(54) GOLF CLUB HEAD WITH GAS CUSHION

(75) Inventors: Wen-Ching Hou, Kaohsiung (TW); Yu-Hong Chen, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 173 days.

(21) Appl. No.: 10/865,896

(22) Filed: Jun. 14, 2004

(65) Prior Publication Data

US 2005/0266931 A1 Dec. 1, 2005

(30) Foreign Application Priority Data

May 26, 2004 (TW) ..... 93114901

(51) Int. Cl.
*A63B 53/04* (2006.01)

(52) U.S. Cl. ..... 473/326; 473/332; 473/350

(58) Field of Classification Search ..... 473/326, 473/332, 333, 346

See application file for complete search history.

(56) References Cited

U.S. PATENT DOCUMENTS 2,635,385 A * 4/1953 Brown ..... 446/187
3,617,589 A * 11/1971 Jones-Hinton et al. ..... 264/453
3,817,522 A * 6/1974 Simmons ..... 473/332
5,064,197 A * 11/1991 Eddy ..... 473/326
5,195,747 A * 3/1993 Choy ..... 473/333
5,290,036 A 3/1994 Fenton et al.
5,584,770 A * 12/1996 Jensen ..... 473/350
5,904,628 A * 5/1999 MacKay et al. ..... 473/326
6,019,687 A * 2/2000 Blowers ..... 473/326
2004/0166959 A1* 8/2004 Chen ..... 473/326

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head includes a body, a striking plate engaged with the body and including a front side for striking a golf ball, and at least one gas cushion mounted in the body and behind the striking plate. The gas cushion includes a bladder defining a gas chamber. The bladder is made of an elastomeric material. The gas chamber is filled with at least a gas to provide said at least one gas cushion with compressibility.

8 Claims, 7 Drawing Sheets

GOLF CLUB HEAD WITH GAS CUSHION

This Nonprovisional application claims priority under 35 U.S.C. 119(a) on patent application Ser. No(s). 93114901 filed in TAIWAN on May 26, 2004, the entire contents of which are hereby incorporated by reference.

BACKGROUND OF THE INVENTION

1. Field of the Invention

The present invention relates to a golf club head. In particular, the present invention relates to a golf club head with at least one gas cushion for effectively absorbing residual vibrations and assuring striking effect.

2. Description of Related Art

U.S. Pat. No. 5,290,036 discloses a cavity back iron with vibration damping material in the cavity. As illustrated in FIG. 1 of the drawings, the golf club disclosed in U.S. Pat. No. 5,290,036 comprises a head 100 including a striking face 101 and a back cavity 102, which is substantially filled with polyurethane 200 (or damping material). When striking a golf ball with the golf club, the damping material 200 may absorb residual vibrations and thus improve gripping comfort.

To improve striking accuracy and direction controllability of the golf ball, when the golf ball begins to contact with the striking face 101, the striking face 101 should be rapidly and significantly compressed when subjected to a slight striking stress, and the striking face 101 should rapidly resume its shape, creating a greater restoring force to be fed to the golf ball. The striking face 101 creates a rearward stress during continuous deformation of the striking face 101, which causes compression of the damping material 200.

However, since the damping material 200 has a low elastic deforming capability, in the beginning of deformation of the striking face 101, the damping material 200 overpresses against the striking face 101 and thus adversely affects the striking effect. Further, from the time of initial contact between the head 100 and the golf ball to the time the ball leaves the head 100, the striking face 101 could not effectively flex rearward to prolong the contact time with the golf ball due to overpressing by the damping material 200. Thus, the damping material 200 fails to provide the best damping effect, and the overall striking distance (i.e., the flying distance of the golf ball) decreases significantly.

OBJECTS OF THE INVENTION

An object of the present invention is to provide a golf club head including at least one gas cushion for effectively absorbing residual vibrations without sacrificing the striking momentum, thereby improving gripping comfort, improving striking controllability, and assuring the overall striking effect.

Another object of the present invention is to provide a golf club head including a gas cushion with a plurality of vents communicated with a cavity of the golf club head, thereby effectively absorbing residual vibrations and improving gripping comfort.

A further object of the present invention is to provide a golf club head containing gas and liquid for effectively absorbing residual vibrations, thereby improving gripping comfort

SUMMARY OF THE INVENTION

In accordance with an aspect of the present invention, a golf club head comprises a body, a striking plate engaged with the body and including a front side for striking a golf ball, and at least one gas cushion mounted in the body and behind the striking plate. The gas cushion includes a bladder defining a gas chamber. The bladder is made of an elastomeric material. The gas chamber is filled with at least a gas to provide said at least one gas cushion with compressibility.

The elastomeric material of the bladder is selected from the group including rubber, polyurethane, thermoplastic elastomers, and high-molecular elastomeric resins. The elastomeric material has a hardness between Shore A 40 and Shore D 40.

In an embodiment of the invention, the gas chamber in the bladder is sealed and has a pressure not lower than atmosphere.

In another embodiment of the invention, the gas chamber is sealed and further contains liquid. The liquid is selected from the group including water, oil, gel-like fluid, non-corrosive water solution, organic solution, mixed solution, and viscous solution.

In a further embodiment of the invention, the bladder includes a plurality of vents providing communication between the gas chamber and atmosphere.

In still another embodiment of the invention, the body is an iron club head body including a back cavity and a compartment. The back cavity exposes the rear side of the striking plate, and the gas cushion is received in the compartment. The compartment has a rearward-facing opening. The rear side of the striking plate delimits the compartment. A portion of the gas cushion is in intimate contact with the rear side of the striking plate. The gas cushion is in intimate contact with the rear side of the striking plate at a location opposite to a sweet spot of the striking plate. Alternatively, the gas cushion is in intimate contact with the rear side of the striking plate at a location opposite to a residual vibration concentrating area.

In still another embodiment of the invention, the compartment has an upward-facing opening and communicated with the back cavity. The compartment is delimited by the rear side of the striking plate, and the gas cushion received in the compartment is in intimate contact with the rear side of the striking plate. The body may include a weight member extending upward from a bottom thereof for adjusting a center of gravity of the golf club head. In this case, the compartment is defined between the weight member and the rear side of the striking plate.

In yet another embodiment of the invention, the compartment has a rearward-facing opening and is not communicated with the back cavity and not delimited by the rear side of the striking plate such that the gas cushion is not in direct contact with the rear side of the striking plate.

In still another embodiment of the invention, the body is a wooden club head body that is sealed to form an interior space. The interior space includes an insertion section at a bottom portion thereof, and the gas cushion is received in the insertion section. Preferably, the insertion section is adjacent to the rear side of the striking plate, and a portion of the gas cushion is in intimate contact with the rear side of the striking plate. In a modified embodiment of the invention, the insertion section is adjacent to a rear inner wall of the body, and the gas cushion is in intimate contact with the rear inner wall of the body.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
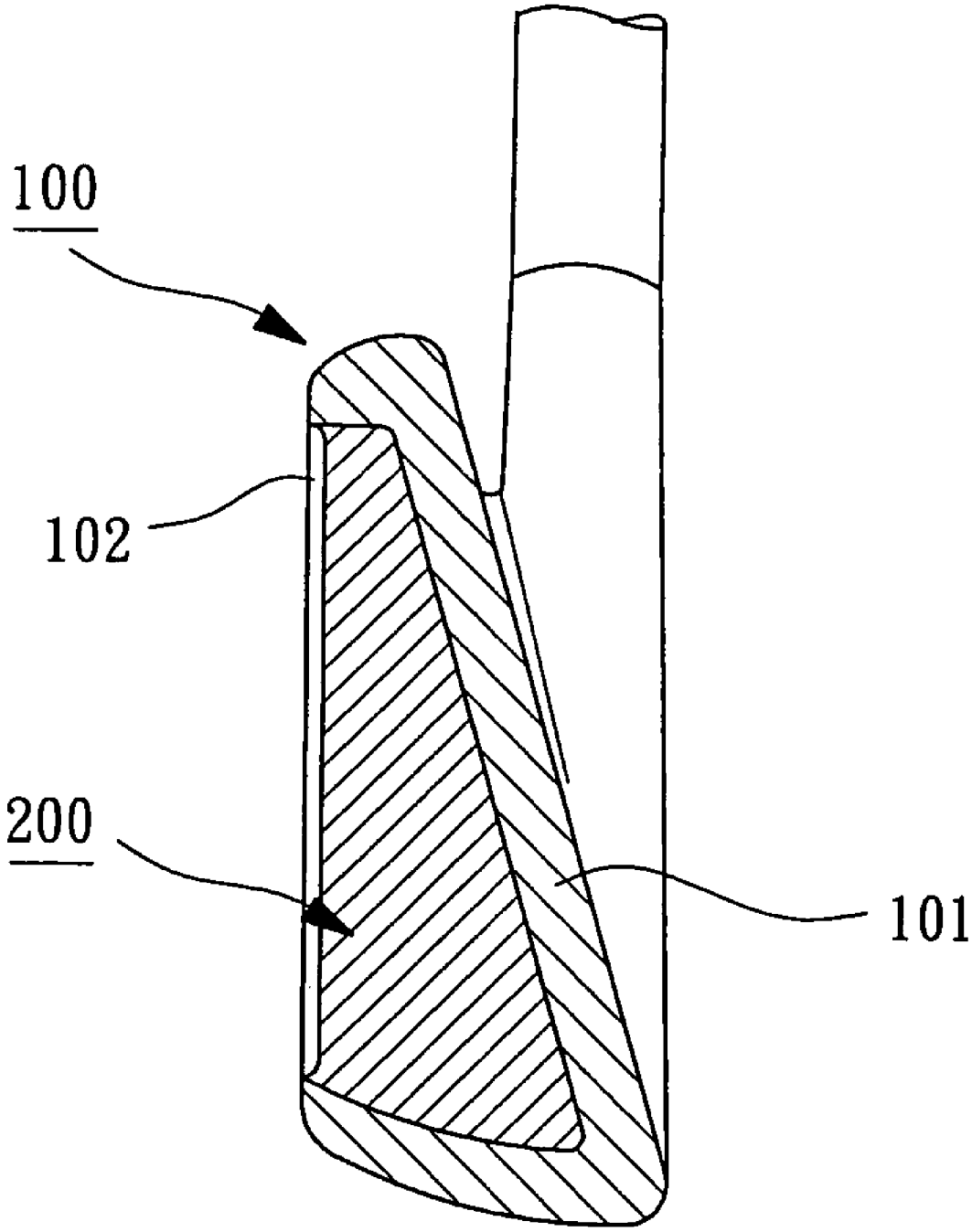
FIG. 1 PRIOR ART
FIG. 1 is a sectional view of a conventional golf club head.

Preferred embodiments of the present invention are now to be described in detail, in which the like reference numerals denote like elements.

Figure 2:
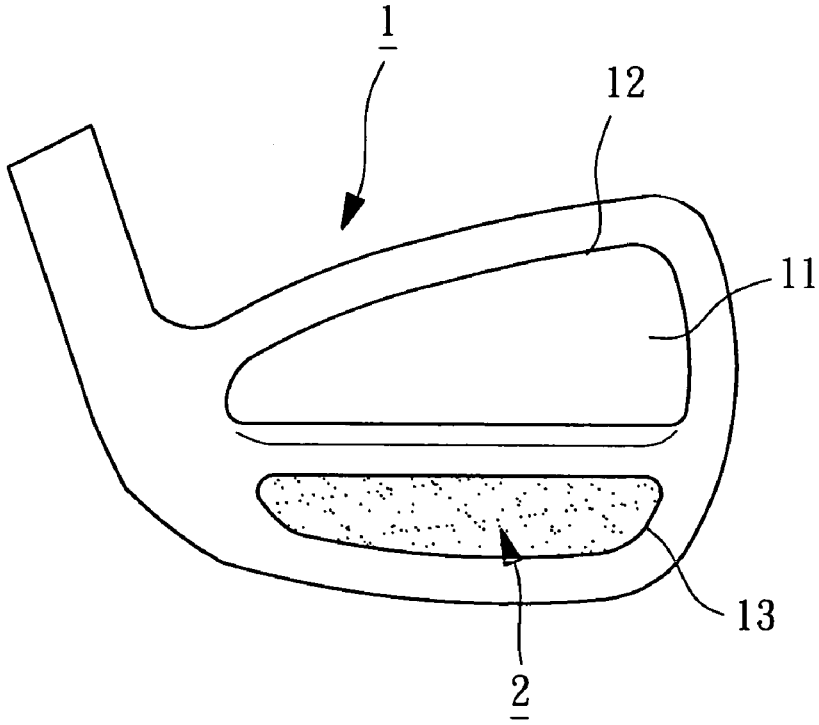
FIG. 2 is a rear view of a first embodiment of a golf club head in accordance with the present invention.
Figure 3:
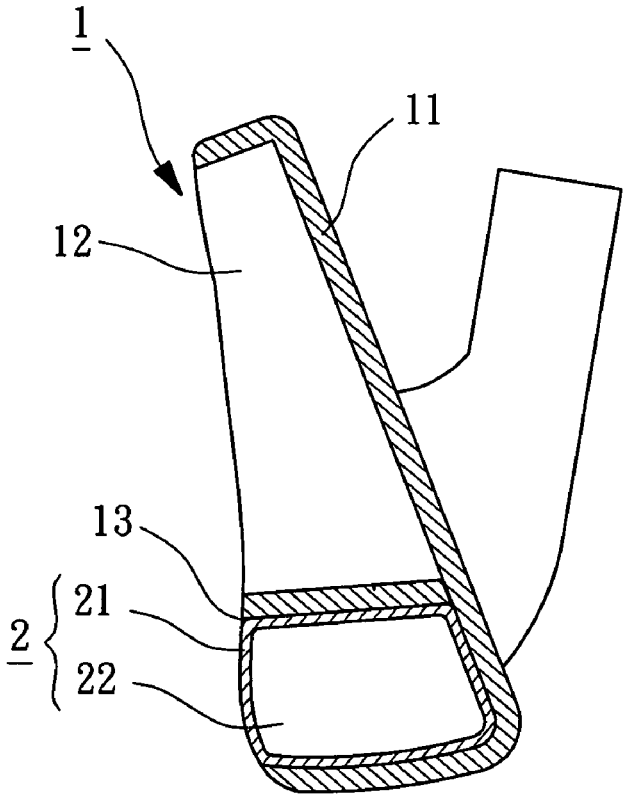
FIG. 3 is a sectional view of the golf club head in FIG. 2.

Referring to FIGS. 2 and 3, a first embodiment of a golf club head in accordance with the present invention comprises a body 1 and at least one gas cushion 2. The body 1 is a body for an iron club head. The body 1 is engaged with a striking plate 11 and includes a back cavity 12 and a compartment 13. The body 1 can be engaged with the striking plate 11 by welding, brazing, insertion, or screwing. The striking plate 11 has a front side for striking golf balls. Alternatively, the body 1 and the striking plate 11 can be integrally formed with each other, with the striking plate 11 being a striking face of the body 1 for striking golf balls.

The back cavity 12 is defined in a rear side of the body 1. The rear side of the body 1 is thus exposed. The compartment 13 is defined in a lower portion of the rear side of the body 1 and includes a rearward-facing opening (not labeled). Preferably, the compartment 13 is delimited by a rear side of the striking plate 11. The gas cushion 2 is received in the compartment 13 and bonded to a perimeter wall delimiting the compartment 13. Preferably, the gas cushion 2 is in intimate contact with the rear side of the striking plate 11, particularly at an area opposite to the sweet spot or the residual vibration concentrating area, such as the heel or toe of the rear side of the striking plate 11.

The gas cushion 2 includes a bladder 21 defining a gas chamber 22 therein. The bladder 21 is made of an elastomeric material such as rubber, polyurethane (PU), thermoplastic elastomers, or high-molecular elastomeric resins. The bladder 21 can be made of a transparent material. The elastomeric material preferably has a hardness between Shore A 40 and Shore D 40. The gas chamber 22 defined in the bladder 21 is sealed, with an appropriate amount of gas being filled into the gas chamber 22 to a pressure not less than the atmosphere.

A plate (not shown) with a trademark or pattern on a side thereof may be placed in the compartment 13 before mounting the gas cushion 2 into the compartment 13. The trademark or pattern can be viewed through the transparent gas cushion 2. Alternatively, the gas cushion 2 can be mounted into the compartment 13 and the plate with trademark or pattern is then adhered to an outer surface of the gas cushion to provide the desired visual effect.

During hitting of a golf ball by the golf club head, the golf ball comes in contact with the striking plate 11 at the first stage, results in maximum deformation of the striking plate 11 at the second stage, and leaves the striking plate 11 at the third stage. During each stage of the golf ball, the striking plate 11 deforms rearward and creates a stress pressing against the gas cushion 2, resulting in continuous compression of the gas cushion 2. The volume of the gas cushion 2 changes accordingly.

As mentioned above, an appropriate amount of gas is contained in the gas chamber 22, allowing easy elastic compressive deformation when the gas cushion 2 is subjected to a stress. Namely, at the first stage of the golf ball mentioned above, the striking plate 11 begins to elastically deform and imparts a smaller stress to the gas cushion 2, and this stress gradually increases to allow rapid momentary compression of the gas cushion 2. Thus, the golf club head in accordance with the present invention avoids the gas cushion 2 from overpressing against the striking plate 11 at the first stage, prolonging the contact time between the golf ball and the striking face 11 while assuring the overall striking effect.

At the second stage mentioned above, the striking plate 11 reaches its maximum deformation and creates the maximum stress that compresses the gas cushion 2 to the maximum extent. The gas cushion 2 bears the striking plate 11 and further prolongs the contact time between the golf ball and the striking plate 11, further improving the direction controllability and striking accuracy of the golf ball.

At the third stage mentioned above, the stress from the striking plate 11 gradually reduces to zero. In response, the volume of the gas cushion 2 rapidly resumes its original value. Thus, after the golf ball has been stricken, although a part of momentum is not imparted to the golf ball and thus results in residual vibrations of the striking plate 11, the gas cushion 2 in intimate contact with the rear side of the striking plate 11 effectively absorbs the residual vibrations and thus improves the gripping comfort.

Figure 4:
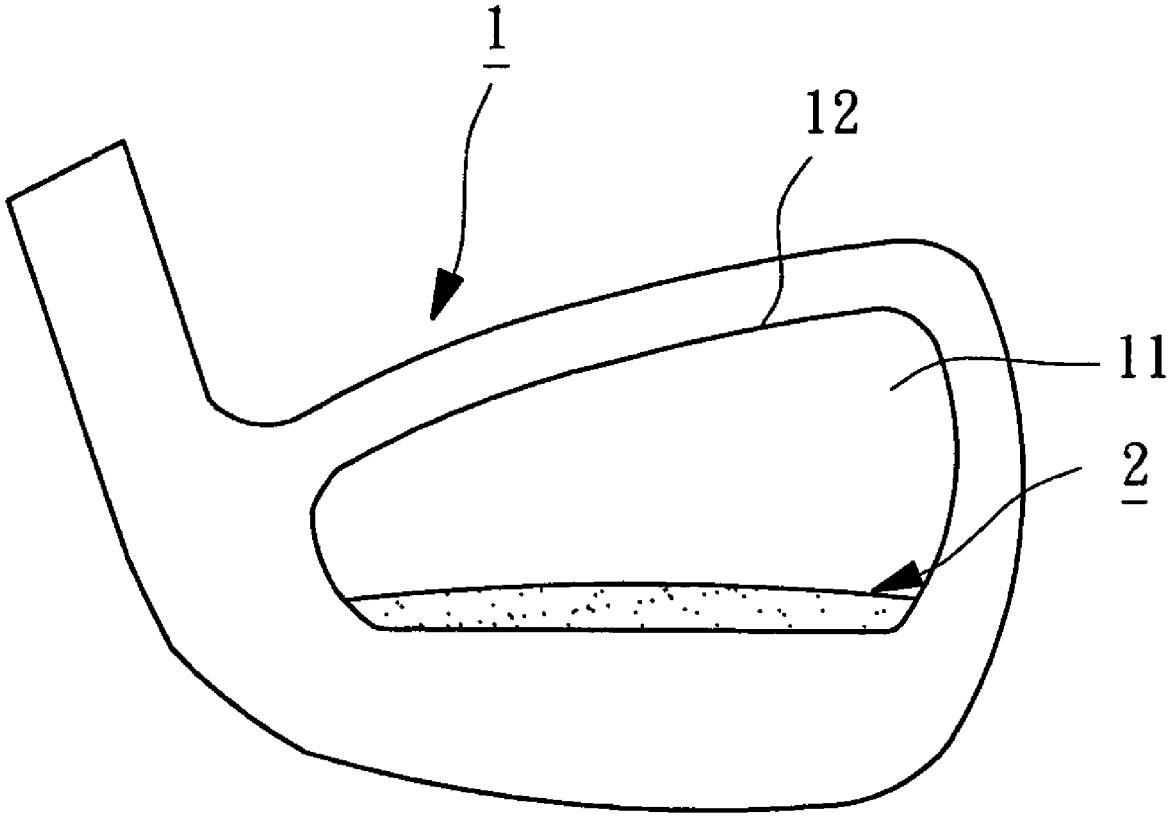
FIG. 4 is a rear view of a second embodiment of the golf club head in accordance with the present invention.
Figure 5:
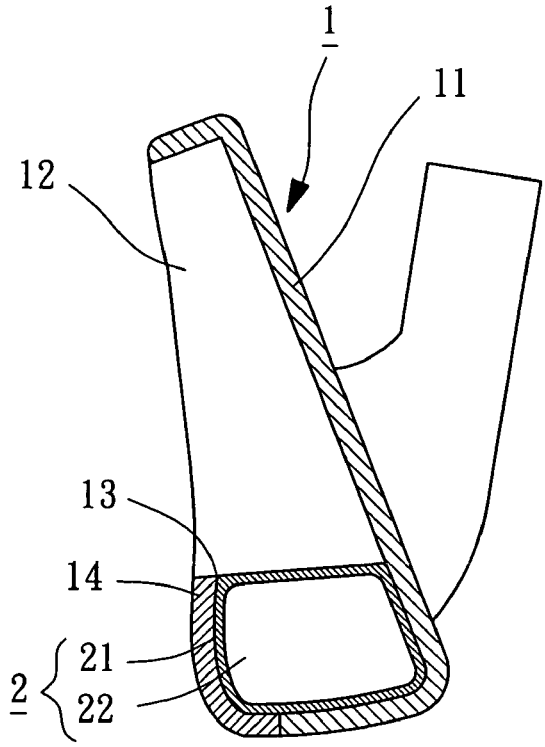
FIG. 5 is a sectional view of the golf club head in FIG. 4.

FIGS. 4 and 5 illustrate a second embodiment of the invention, wherein the opening of the compartment 13 faces upward and communicates with the back cavity 12. The compartment 13 is delimited by the rear side of the striking plate 11. The gas cushion 2 is received in the compartment 13 and is in intimate contact with the rear side of the striking plate 11. The body 1 may include an extension extending upward from a bottom thereof, forming a weight member 14 for adjusting a center of gravity of the golf club head. Thus, the compartment 13 is defined between the weight member 14 and the rear side of the striking plate 11. By such an arrangement, the gas cushion 2 assures the overall striking effect, improves direction controllability and striking accuracy of the golf ball, effectively absorbs the residual vibrations and improves gripping comfort.

Figure 6:
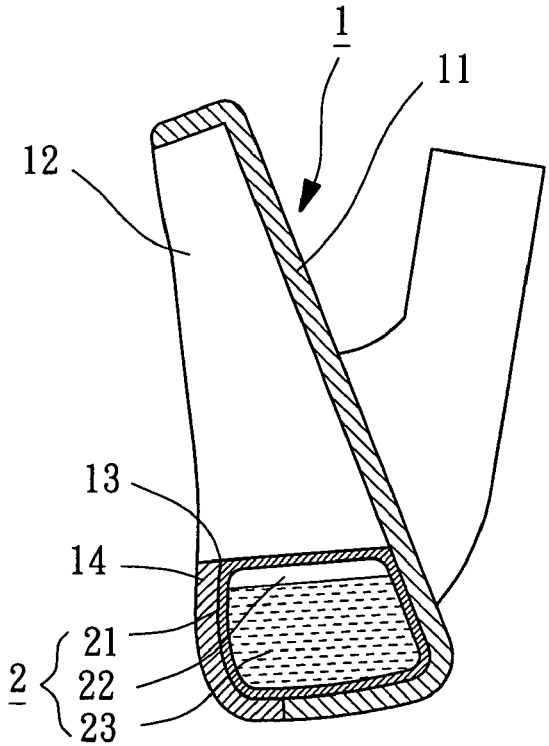
FIG. 6 is a sectional view of a third embodiment of the golf club head in accordance with the present invention.

FIG. 6 illustrates a third embodiment of the invention, wherein the gas chamber 22 may contain an appropriate amount of liquid 23 and an appropriate amount of gas. The liquid 23 may be water, oil, gel-like fluid, non-corrosive water solution, organic solution, mixed solution, or viscous solution. When hitting a golf ball with the body 1, the liquid 23 in the gas chamber 22 provides a damping effect due to viscosity, thereby absorbing the residual vibrations of the body 1. Further, the gas in the gas chamber 22 maintains the compression characteristics of gas for the gas cushion 2.

Figure 7:
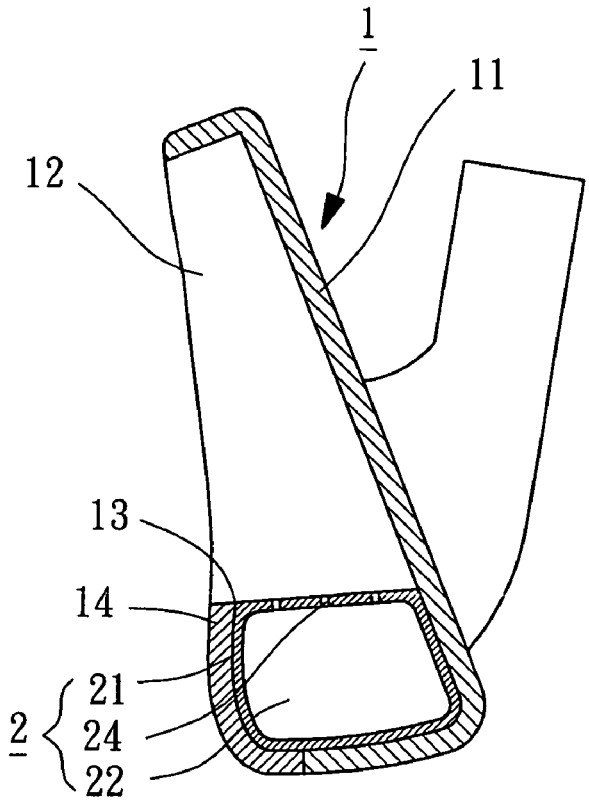
FIG. 7 is a sectional view of a fourth embodiment of the golf club head in accordance with the present invention.

FIG. 7 illustrates a fourth embodiment of the invention, wherein the bladder 21 of the gas cushion 2 includes a plurality of vents 24 that provides communication between the gas chamber 22 and the atmosphere (e.g., via the back cavity 12). When hitting a golf ball with the body 1, the gas cushion 2 absorbs the residual vibrations while the vents 24 allow release of the gas in the gas chamber 22 to speed up compression of the gas cushion 2.

Figure 8:
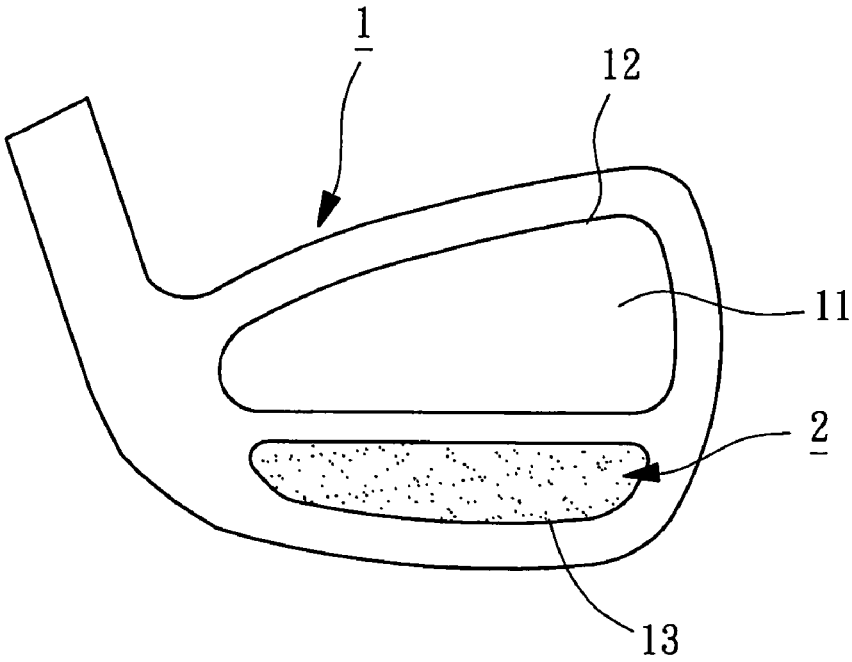
FIG. 8 is a rear view of a fifth embodiment of the golf club head in accordance with the present invention.
Figure 9:
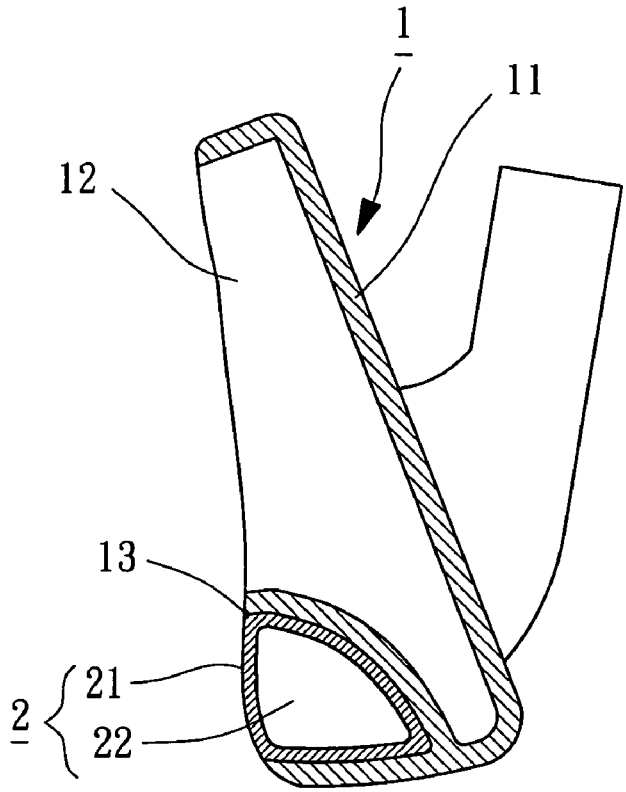
FIG. 9 is a sectional view of the golf club head in FIG. 8.

FIGS. 8 and 9 illustrate a fifth embodiment of the invention, wherein the compartment 13 is formed at a rear lower portion of the body 1 and has a rearward-facing opening. The compartment 13 is not communicated with the back cavity 2 and not in contact with the rear side of the striking plate 11. The gas cushion 2 is received in the compartment 13. By such an arrangement, when hitting a golf ball with the body 1, the gas cushion 2 is still capable of absorbing the residual vibrations via the body 1. Further, since the gas cushion 2 is not in direct contact with the striking plate 11, undesirable reduction in the momentum of the striking plate 11 can be avoided.

Figure 10:
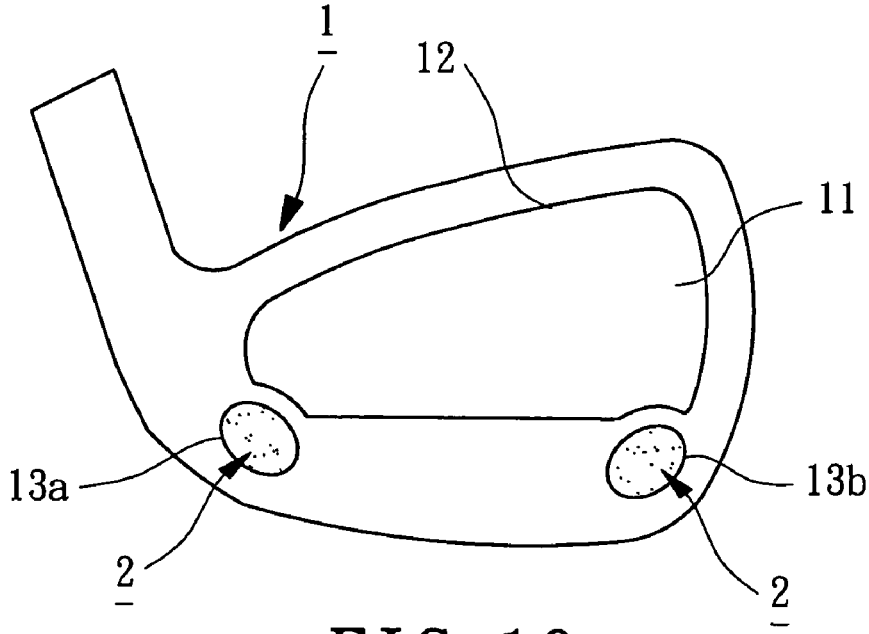
FIG. 10 is a rear view of a sixth embodiment of the golf club head in accordance with the present invention.

FIG. 10 illustrates a sixth embodiment of the invention, wherein the body 1 includes a first compartment 13*a* in the heel and a second compartment 13*b* in the toe. Location of the first compartment 13*a* and the second compartment 13*b* corresponds to the concentration area of the residual vibrations of the body 1. The first and second compartment 13*a* and 13*b* may be communicated with the back cavity 12 and delimited by the rear side of the striking plate 11. Alternatively, the first and second compartments 13*a* and 13*b* are not communicated with the back cavity 12 and not delimited by the rear side of the striking plate 11. Each compartment 13*a*, 13*b* receives a gas cushion 2. When hitting a golf ball with the body 1, the gas cushions 2 directly absorb the residual vibrations of the striking plate 11 or indirectly absorb the residual vibrations via the body 1.

Figure 11:
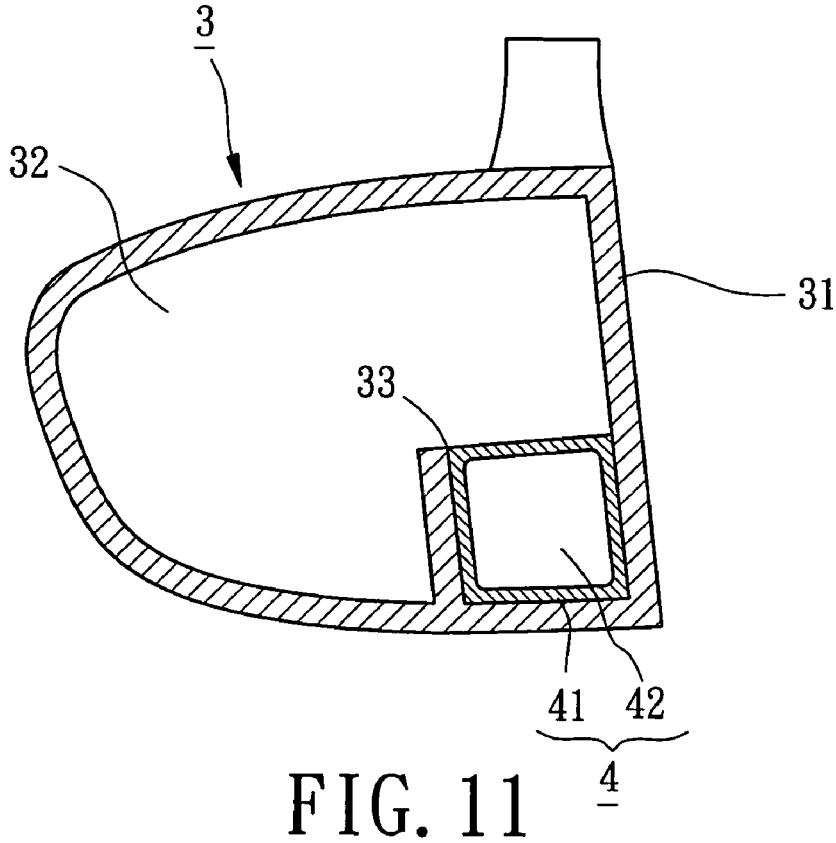
FIG. 11 is a sectional view of a seventh embodiment of the golf club head in accordance with the present invention.

FIG. 11 illustrates a seventh embodiment of the invention, wherein the golf club head is a wooden club including a body 3 and a gas cushion 4. The body 3 includes an interior space 32 and an insertion section 33. The body 3 is engaged with a striking plate 31 by any suitable means. The interior space 32 is behind the striking face 31 and is closed. The insertion section 33 is located at the bottom of the interior space 32 and adjacent to the striking face 31. The gas cushion 4 includes a bladder 41 defining a gas chamber 42 therein. The bladder 41 is bonded into the insertion section 33. Thus, a portion of the bladder 41 is in intimate contact with a rear side of the striking face 31, particularly at an area opposite to the sweet spot or the residual vibration concentrating area, such as the heel or toe of the rear side of the striking plate 11. The gas in the gas chamber 42 can be compressed, as in the above embodiments. When hitting a golf ball with the body 3, the gas cushion 4 directly absorbs the residual vibrations of the striking plate 31, thereby assuring the overall striking effect, improving direction controllability and striking accuracy, effectively absorbing the residual vibrations, and improving gripping comfort.

Figure 12:
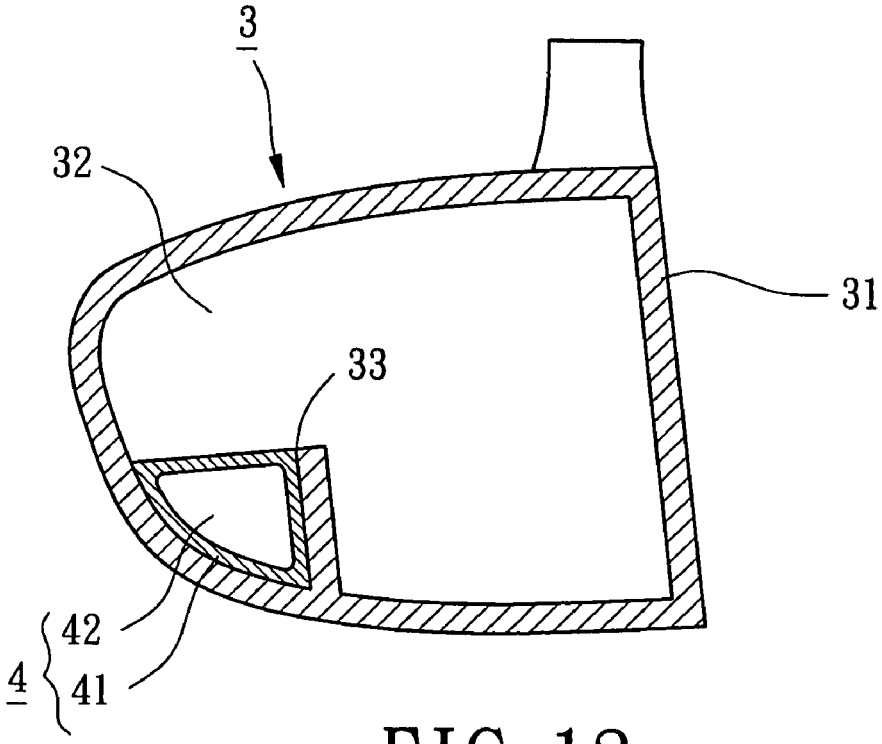
FIG. 12 is a sectional view of an eighth embodiment of the golf club head in accordance with the present invention.

FIG. 12 illustrates an eighth embodiment of the invention that is modified from the seventh embodiment. In this embodiment, the insertion section 33 is located at a rear lower portion of the body 3, with the gas cushion 4 being in intimate contact with a rear inner wall of the body 3. When hitting a golf ball with the body 3, although the gas cushion 4 is not in contact with the rear side of the striking plate 31, the residual vibrations can be indirectly absorbed by the gas cushion 4 via the body 3.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body including a striking plate being engaged therewith, the body further including a front side and a rear side, the body being constructed from an iron club head body including a back cavity and an unsealed compartment, the back cavity exposing the rear side of the striking plate, the body further including a club weight member extending upward from a bottom thereof, the unsealed compartment being defined between the club weight member and the rear side of the striking plate; and at least one gas cushion mounted in the body and behind the striking plate, said at least one gas cushion including a bladder defining a gas chamber, the bladder being made of an clastomeric material, the gas chamber being filled with a gas to provide said at least one gas cushion with compressibility, said at least one gas cushion being received in the unsealed compartment of the body and conforming to the shape of the compartment;

said compartment has an upward-facing opening and communicated with the back cavity, said at least one gas cushion being in intimate contact with the rear side of the striking plate.

2. The golf club head as claimed in claim 1, wherein the elastomeric material of the bladder is selected from the group including rubber, polyurethane, thermoplastic elastomers, and high-molecular elastomeric resins.

3. The golf club head as claimed in claim 1, wherein the elastomeric material has a hardness between Shore A 40 and Shore D 40.

4. The golf club head as claimed in claim 1, wherein the gas chamber in the bladder is sealed and has a pressure not lower than atmosphere.

5. The golf club head as claimed in claim 1, wherein the gas chamber is sealed and further contains liquid.

6. The golf club head as claimed in claim 5, wherein the liquid is selected from the group including water, oil, gel-like fluid, non-corrosive water solution, organic solution, mixed solution, and viscous solution.

7. The golf club head as claimed in claim 1, wherein said at least one gas cushion is in intimate contact with the rear side of the striking plate at a location opposite to a sweet spot of the striking plate.

8. The golf club head as claimed in claim 1, wherein said at least one gas cushion is in intimate contact with the rear side of the striking plate at a location opposite to a residual vibration concentrating area.

* * * * *